US006182909B1

(12) United States Patent
Kah, Jr. et al.

(10) Patent No.: US 6,182,909 B1
(45) **Date of Patent: *Feb. 6, 2001**

(54) ROTARY NOZZLE ASSEMBLY HAVING INSERTABLE ROTATABLE NOZZLE DISC

(76) Inventors: Carl L. C. Kah, Jr., 778 Lakeside Dr.; Carl L. C. Kah, III, 12166 W. End, both of N. Palm Beach, FL (US) 33408

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/128,130

(22) Filed: Aug. 3, 1998

(51) Int. Cl.[7] ..... B05B 15/10
(52) U.S. Cl. ..... 239/206; 239/394
(58) Field of Search ..... 239/203, 204, 239/205, 206, 394

(56) References Cited

U.S. PATENT DOCUMENTS

| | | | | |
|---|---|---|---|---|
| 3,083,872 | | 4/1963 | Meshberg | 222/42 |
| 3,814,326 | * | 6/1974 | Bartlett | 239/394 X |
| 4,784,325 | | 11/1988 | Walker et al. | 239/204 |

* cited by examiner

*Primary Examiner*—Robert M. Fetsuga
(74) *Attorney, Agent, or Firm*—Jack N. McCarthy

(57) ABSTRACT

A rotary drive sprinkler has a nozzle assembly having a recess in a cylindrical housing for receiving a cylindrical nozzle selection disc having a plurality of nozzle openings. The cylindrical nozzle selection disc is rotatable to place one of its nozzle openings in an exit flow passage in the cylindrical housing. An arc set indicating and setting mechanism is included.

26 Claims, 6 Drawing Sheets

ROTARY NOZZLE ASSEMBLY HAVING INSERTABLE ROTATABLE NOZZLE DISC

TECHNICAL FIELD

This invention relates to rotary drive sprinklers having a nozzle assembly with a rotatable disc having a plurality of nozzle openings which can be selectively aligned with an inner flow opening to achieve a desired flow exiting from the rotary drive sprinkler.

BACKGROUND ART

U.S. patent application Ser. No. 08/405,033 to CARL L. C. Kah, III for OPERATIONALLY CHANGEABLE MULTIPLE NOZZLES SPRINKLER is included here as if fully set forth and provides for change from one nozzle to another by rotationally moving a nozzle selection sleeve and a nozzle plate is disclosed having a nozzle opening which slides into a groove from the top of the nozzle housing.

U.S. patent application Ser. No. 09/104,456 to Carl L. C. Kah, Jr. and Carl L. C. Kah, III for SELECTABLE NOZZLE ROTARY DRIVEN SPRINKLER is included here as if fully set forth and provides for change from one nozzle to another by rotating an internal selection rotor.

Other patents setting forth a background for this invention are: U.S. Pat. Nos. 3,645,451; 4,717,074; 4,625,914; 4,867,378; 5,048,757; 5,104,045; 5,226,599; 5,526,982; 3,762,650; Des, 388,502; Russian Patent No. 975,101 and French Patent No. 2,313,132.

DISCLOSURE OF INVENTION

It is an object of this invention to provide a rotary drive sprinkler with a rotatable nozzle assembly having a rotatable circular nozzle disc having a plurality of different nozzle orifices therearound in a cylindrical recess in the side of the nozzle assembly which can be rotated to place the different sized nozzle orifices over an inner flow opening to achieve a desired flow exiting from the sprinkler. The sprinkler may be shut off at the nozzle assembly by placing the rotatable circular nozzle disc to a position where the disc between two nozzle orifices covers the inner flow opening.

It is another object of this invention to provide for easy removal of the rotatable nozzle disc from the side of the exterior of the nozzle assembly and to insert another rotatable nozzle disc having a different set of nozzle orifices therearound.

It is a further object of the invention to provide an improved rotary drive sprinkler having a rotatable nozzle assembly having a recess therein accessible from the top for receiving a circular nozzle disc which can be rotated by an adjusting screw which can be actuated from the top of the rotatable nozzle assembly.

It is another object of this invention to support the circular nozzle disc for rotation in its recess by having a semicircular shape at the bottom of the recess and insertable arcuate members contoured to fit the circular nozzle disc on each side of the top of the recess.

It is a further object of this invention to provide for indicating from the top of the nozzle assembly the nozzle selected from the nozzles around the circular nozzle disc by a window in the top of the nozzle housing capable of seeing the circumference of the circular nozzle disc which has nozzle identifying marks.

BEST MODE FOR CARRYING OUT THE INVENTION

Figure 1:
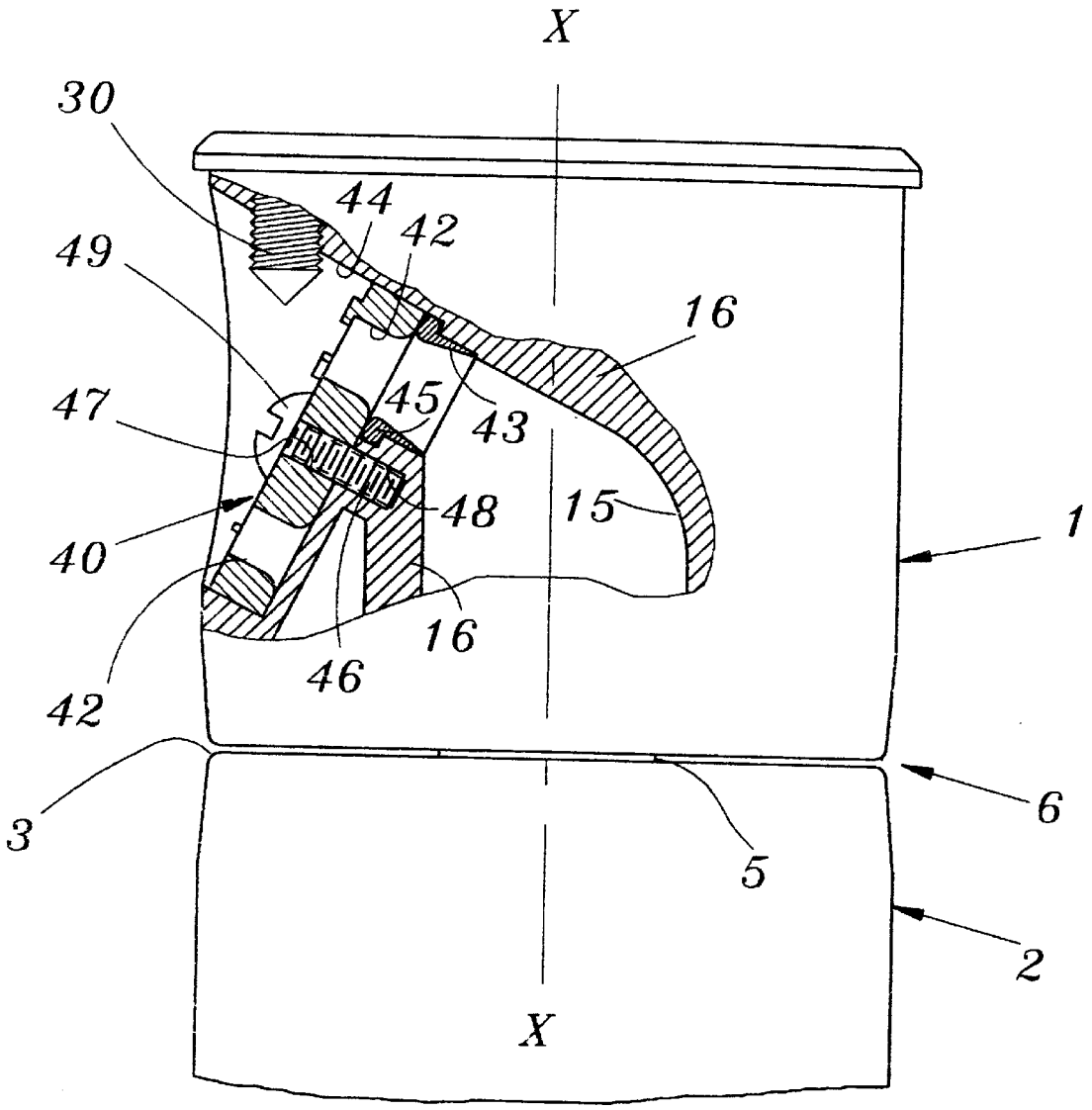
FIG. 1 is a fragmentary sectional side view of a rotatable sprinkler nozzle housing assembly being driven by an output shaft from a riser assembly and showing the rotationally mounted multiple nozzle selection disc which is removable and insertable from an opening on the side of the rotatable nozzle housing.
Figure 2:
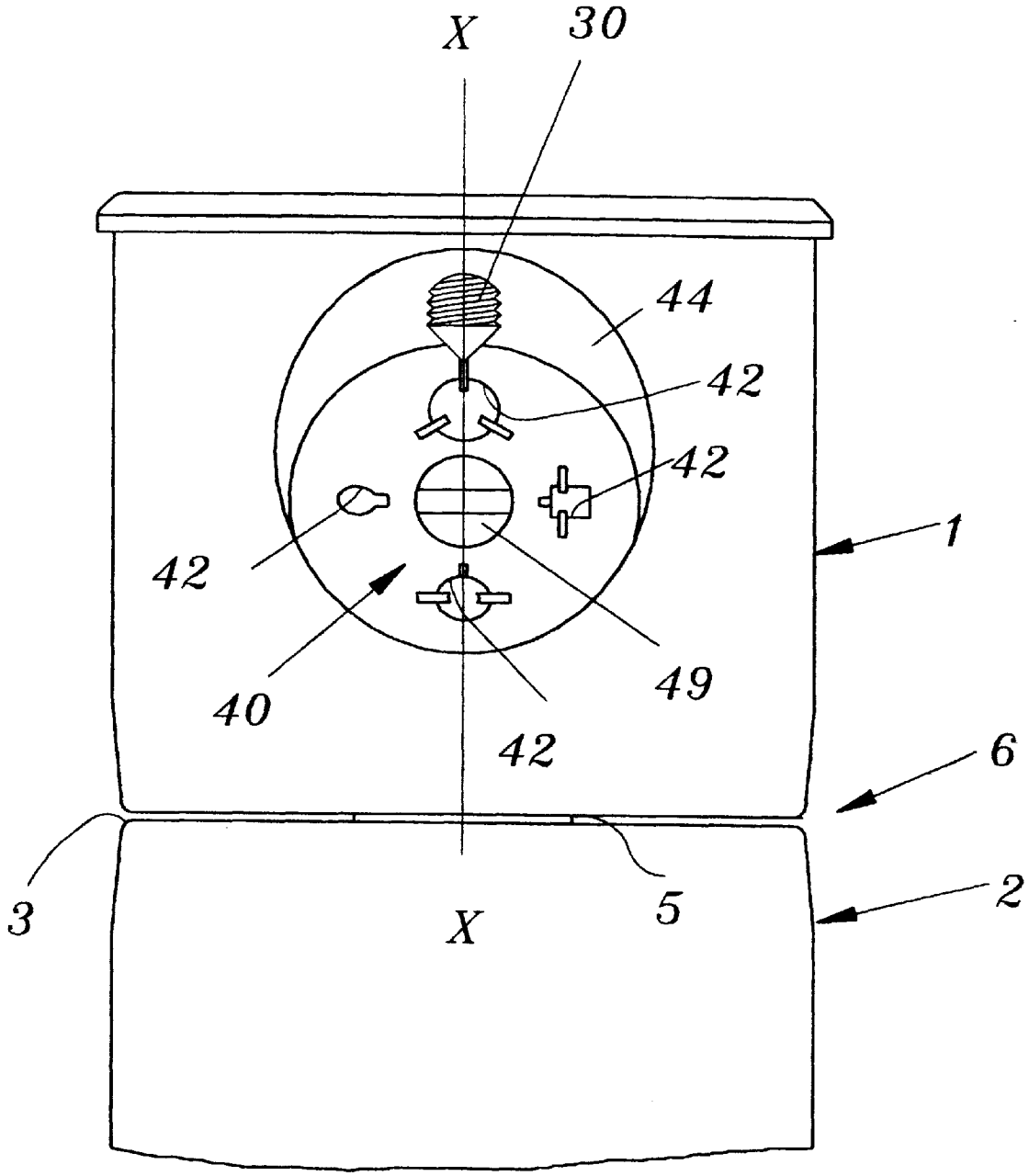
FIG. 2 is a side view of the FIG. 1 configuration showing the nozzle selection disc with its alternatively selectable nozzles.

Referring to FIG. 1 and FIG. 2 of the drawings, a rotatable nozzle sprinkler 6 is shown having a cylindrical nozzle housing assembly 1 mounted for rotation about axis x—x on the top of a riser assembly 2. The riser assembly 2 has an opening 3 at its upper end for a nozzle housing assembly drive shaft 5 to exit the riser assembly 2 and be connected to the nozzle housing assembly 1.

The nozzle drive shaft 5 is hollow and water is supplied to the nozzle housing 16 through a hollow center passage of the nozzle drive shaft 5 into a flow passage 15 in the nozzle housing 16. Water enters the riser assembly 2 at its lower end and is used to power a rotary drive mechanism (not shown) for turning the nozzle drive shaft 5 before exiting the riser assembly 2 through the hollow center passage of the nozzle drive shaft 5. The rotary drive mechanism can be one of many as used in rotary drive sprinklers. Examples are shown in U.S. Pat. Nos. 3,645,451; 4,625,914; 4,624,412; 4,901,924; and 5,048,757.

The flow passage 15 of the nozzle housing 16 extends through the nozzle housing 16 to an opening 43 in the bottom of a cylindrical recess 44 formed in the side of the nozzle housing 16. The cylindrical recess 44 is positioned at an upward angle. The construction of a nozzle housing with a flow passage is shown in U.S. Pat. No. 5,098,021 and U.S. Pat. No. 5,104,045. The flow passage 15 in the nozzle housing does not determine the sprinkler's stream trajectory for this design.

In FIG. 1 a separate nozzle selection disc 40 with multiple individual nozzles 42 molded around the disc 40 is rotationally mounted in cylindrical recess 44 in the side of the nozzle housing 16. Each nozzle 42 can be separately configured to give a desired trajectory angle and range sized to provide a desired flow rate and precipitation rate.

In FIG. 2 the nozzle selection disc 40 can be seen with the different flow rate nozzles 42 shown. The nozzle selection disc 40 is positioned for rotation about its center at the bottom of the cylindrical recess 44 on a shaft 46. Shaft 46 can be a screw, having a slotted screw head 49, passing through an opening 47 at the center of the nozzle selection disc 40 into a threaded opening 48 in the nozzle housing 16. The screw 46 may be loosened to allow rotating a different nozzle into alignment with the opening 43 and be retightened to lock the nozzle into place and secure it against a seal member 45 to the high pressure water passage 15 in the nozzle housing.

The individual nozzles 42 are arranged around the nozzle selection disc 40 so that they become aligned with the opening 43 as the nozzle selection disc 40 is rotated. The cylindrical seal member 45 is located in the opening 43 of the flow passage 15 to engage the nozzle selection disc 40 to provide a sealing action between the flow passage 15 and nozzle selection disc 40. The exit flow from each nozzle 42 when aligned with the opening 43 is directed outwardly from the cylindrical recess 44. A range stream break-up adjustment screw 30 is positioned in the top of the nozzle housing 16 to extend downwardly into the recess 44 in line with the opening 43. This range stream break-up adjustment screw 30 can be moved from a position above the flow exiting from a nozzle 42 to various depths extending into the flow. The positioning in the exit flow can alter the exit flow to deflect it and obtain a different ground coverage. Other types of stream deflection for coverage adjustments, i.e. range, have been used in prior art patents, such as shown in U.S. Pat. No. 4,867,378.

Figure 3:
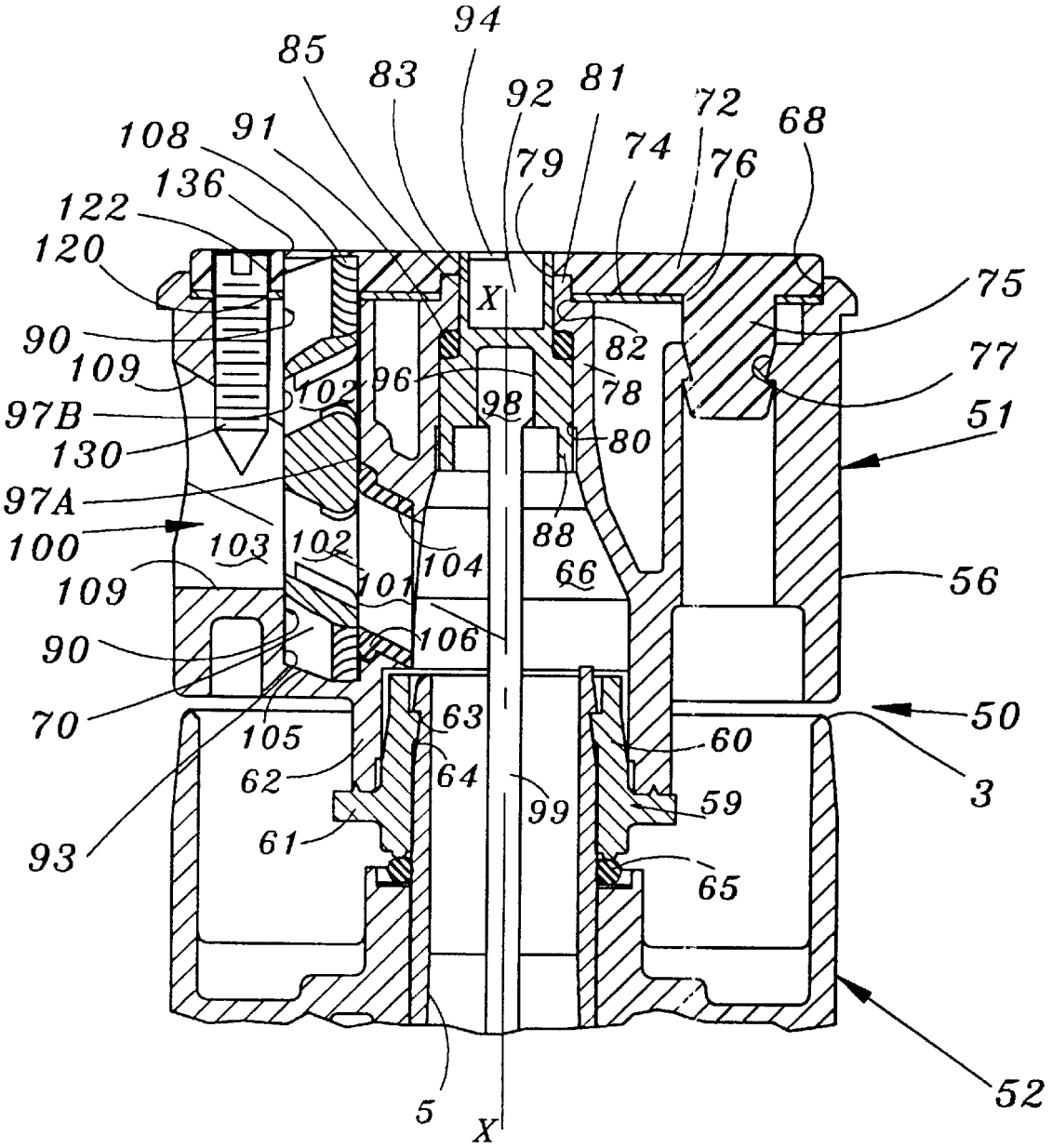
FIG. 3 is a sectioned side view of a modified rotatable sprinkler nozzle housing assembly taken on the line 3—3 of FIG. 4 showing an alternate nozzle selection disc which is removable and insertable from an opening on the top after removal of a nozzle housing cover.
Figure 4:
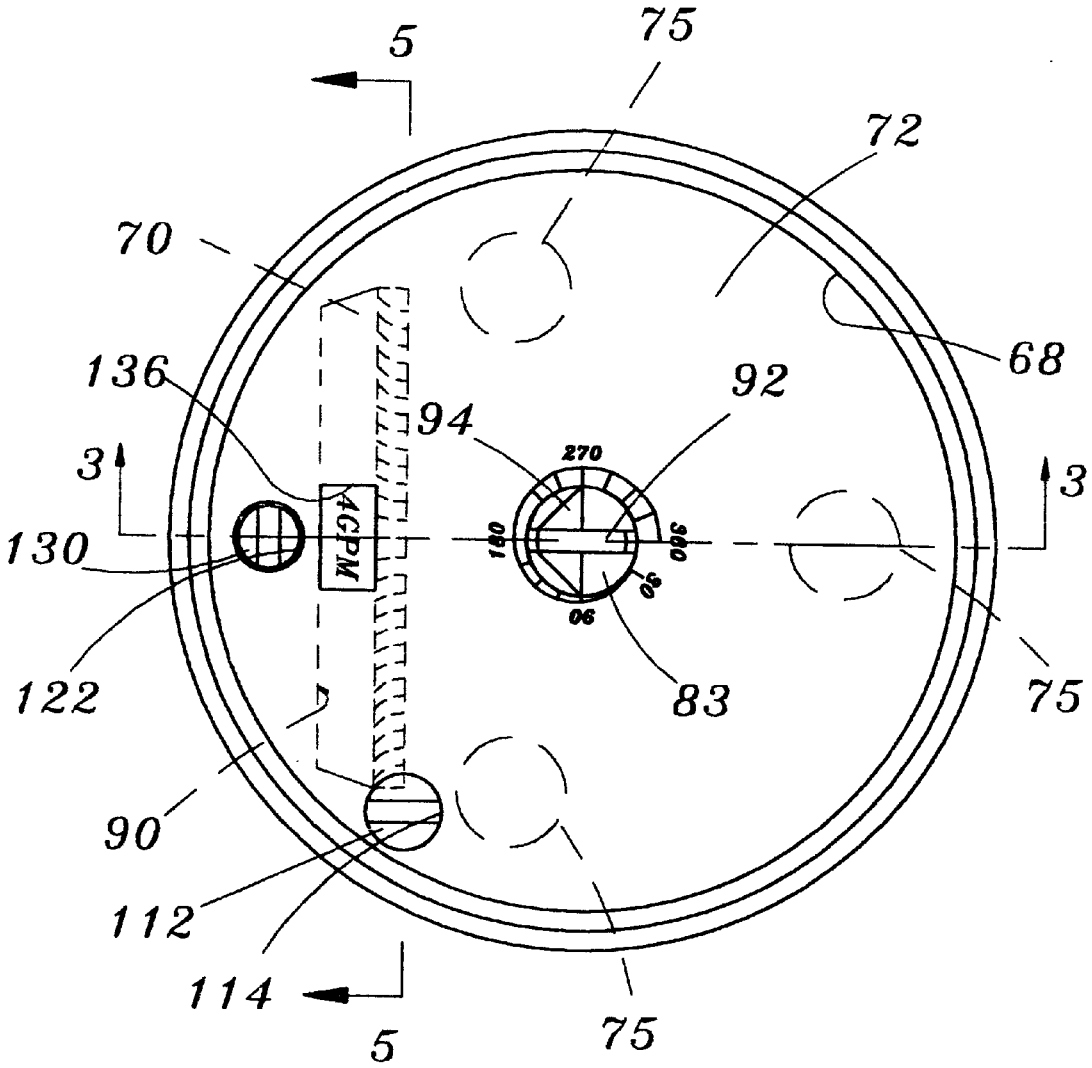
FIG. 4 is a top view of the nozzle housing assembly of FIG. 3 showing a modified nozzle selection disc configuration with a nozzle selection screw for rotating the nozzle selection disc from the top surface of the nozzle housing with the selected nozzle identification such as flow rate, stream elevation angle, range, etc., showing at the top of the nozzle housing to allow selecting the correct nozzle even when the sprinkler is not operating and is in a retracted position in a housing.
Figure 5:
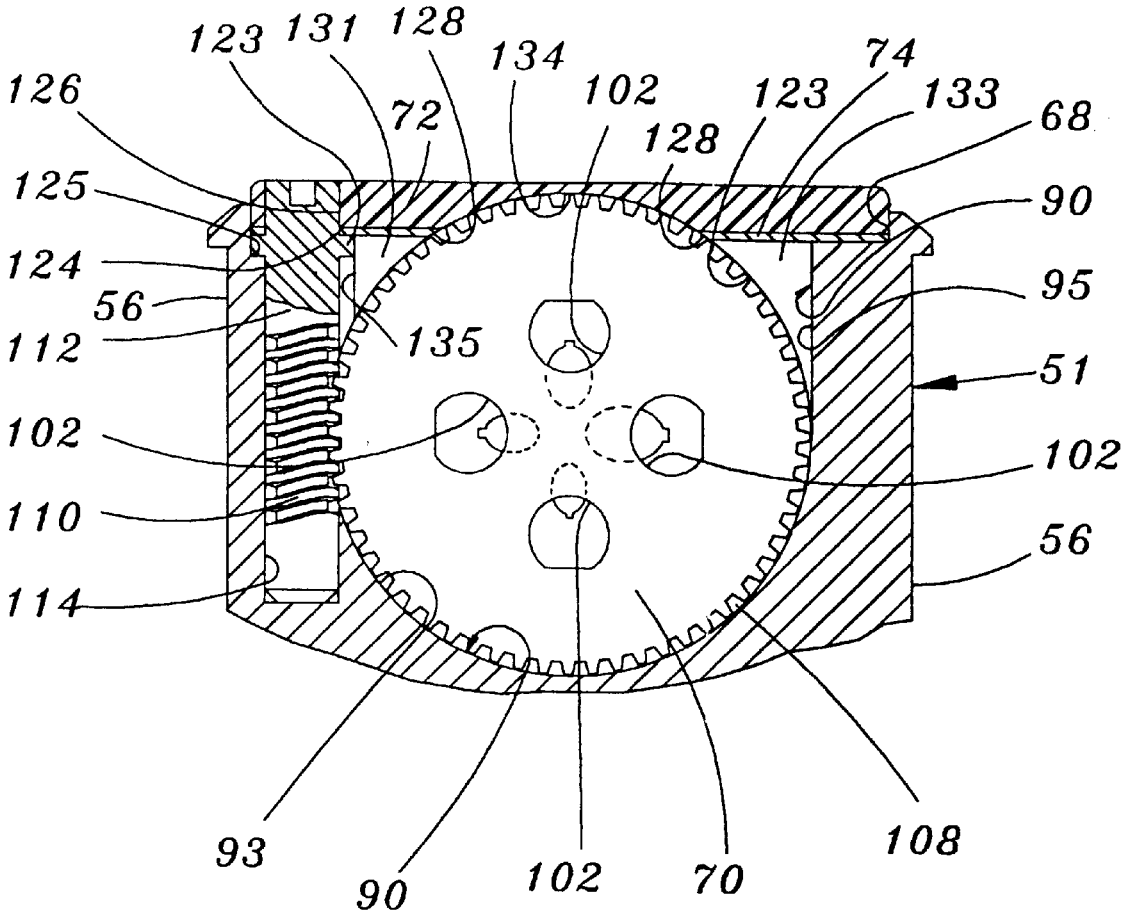
FIG. 5 is a sectional view taken on the line 5—5 of FIG. 4 showing guides for the top for retaining the nozzle selection disc in place and showing the nozzle selection screw for rotating the nozzle selection disc from the top of the nozzle housing.

FIGS. 3, 4 and 5 show an alternate rotating multiple nozzle selectable disc configuration where the nozzle disc can be loaded from the top and is rotatable from the top by a nozzle selection screw. The nozzle selected is indicated on top by a nozzle reference number, or other indication such as by the stream discharge angle, or expected range of the selected nozzle.

Referring to FIG. 3 and FIG. 4 of the drawings, an upper portion of a rotatable sprinkler 50 is shown having a cylindrical nozzle housing assembly 51 mounted for rotation about an axis x—x on top of a riser assembly 52. The riser assembly 52 has an opening 3 at its upper end for a nozzle housing assembly output drive shaft 5 to exit the riser assembly 52 and be connected to the nozzle housing assembly 51. An arc set indicating and setting mechanism is included to set the cylindrical nozzle housing assembly 51 at a specific arc of oscillation, and will be hereinafter described.

The cylindrical nozzle housing assembly 51 has an outer cylindrical nozzle housing 56 which has a center bottom portion formed as a downwardly extending sleeve 62. The sleeve 62 extends into the opening 3 at the upper end of the riser assembly 52. A connecting member 59 which forms part of the cylindrical nozzle housing 56 has a sleeve portion 60 extending upwardly into the sleeve 62 to be fixed thereto to receive the drive shaft 5 extending from the riser assembly 52. The drive shaft 5 is fixed in the sleeve portion 60 in a manner to be hereinafter described.

The connecting member 59 extends outwardly as a cylindrical flange 61 to be fixedly connected to the bottom of the downwardly extending sleeve 62 to close off the bottom of cylindrical nozzle housing assembly 51.

The sleeve 62 is fixed to flange 61 by sonic welding. Other known means can be used to fix these parts together. Drive shaft 5 is fixed in the sleeve portion 60 by a snap fit at 63 and rotationally locked against rotation by a splined connection 64 therebetween. An "O"-ring seal 65 is located between the output drive shaft 5 and part of the riser assembly 4 as a dirt seal.

The interior of the outer cylindrical nozzle housing 56 is formed having a center flow chamber 66 located above the sleeve member 60 to receive flow from the hollow drive shaft 5 for delivery to a cylindrical nozzle selection disc 70 to be hereinafter described. The cylindrical nozzle housing assembly 51 has a top as shown in FIG. 4. A recess 68 extends around the upper end of the cylindrical nozzle housing 56 to receive a rubber cover 72 and a support and reenforcing plate 74. The rubber cover 72 and plate 74 are fixed in place by three (3) cylindrical rubber holding plugs 75 (one shown in FIG. 3) spaced around the circumference of the cylindrical nozzle housing 56. The cylindrical rubber holding plugs 75 extend from the rubber cover 72 and extend through openings 76 in the plate to be received and releasably held in openings 77 formed in the cylindrical nozzle housing 56 by a snap fit. Other holding members can be used.

The cylindrical nozzle housing 56 has a cylindrical member 78 extending upwardly from the flow chamber 66. The cylindrical member 78 has a smaller cylindrical opening 79 in the upper part, and a larger aligned cylindrical opening 80 in the lower part. The cylindrical member 78 has a small cylindrical extension 81 at the top thereof having a smaller diameter. The small cylindrical extension 81 extends through an opening 82 in the plate 74 into the rubber cover 72 to support the plate 74 and rubber cover 72.

The arc set indicating and setting mechanism shown in FIG. 3 includes an arc set indicating cylinder member 83 having an upper smaller section 85 with a rotating fit in smaller cylindrical opening 79 in cylindrical member 78. The arc set indicating cylinder member 83 has a lower larger section 88 with a rotating fit in larger cylindrical opening 80. An "O"-ring 91 is positioned between the arc set indicating cylinder member 83 and the interior of the cylindrical member 78 of the cylindrical nozzle housing 56. This location of the "O"-ring 91 is where the larger and smaller openings of cylindrical member 78 meet and the larger and smaller sections of the arc set indicating cylinder member 83 meet.

The arc set indicating cylinder member 83 extends through an opening in the rubber cover 72 and has a recess 92 in the top thereof to receive a key (or flat screwdriver) for turning it. The recess 92 has an arrowhead 94 formed at one end to point to numbers around the arc set indicating member 83 to indicate the arc of oscillation which has been set, or the change of oscillation being set. The arc set indicating cylinder member 83 has an elongated slot 96 at the bottom thereof to receive a mating flattened end 98 of an angular positioning shaft 99. The angular positioning shaft 99 extends into the hollow drive shaft 5 of the riser assembly 52. These shafts, hollow output drive shaft 5 and angular positioning shaft 99, are connected to a mechanism to control the arc of oscillation set.

Such an arc set control mechanism is shown in U.S. Pat. No. 4,901,924, issued Feb. 20, 1990, and U.S. Pat. No. 5,417,370, issued May 23, 1995, and these patents are incorporated herein by reference as though fully set forth.

The cylindrical nozzle selection disc 70 has multiple individual nozzles 102 molded around the disc. The nozzles 102 have nozzle passages that can be formed into various shapes and sizes as required to provide the desired flow rate, range, stream elevation angle, etc., by controlling the shape of a nozzle passage from the front and back. The circumferential surface of the nozzle selection disc 70 tapers downwardly at 105 to allow molding the nozzle identification information on this surface and has partial gear teeth 108 around its rear outside circumference to receive worm gear nozzle selection shaft teeth 110 for rotating the nozzle selection disc 70 to the desired nozzle as indicated in window 136, shown in FIG. 3 and FIG. 4.

The cylindrical nozzle selection disc 70 is received in a recess 90 in the cylindrical nozzle housing assembly 51 between the flow chamber 66 and the exterior of the cylindrical nozzle housing 56. Recess 90 has a semi-circular bottom portion 93; with upper straight end portions 95 and straight sides 97A and 97B extending to the top of the nozzle housing 56 permitting the nozzle selection disc 70 to be placed in the nozzle housing 56 for rotation. A worm gear nozzle selection shaft 112 is mounted in a cylindrical unthreaded hole 114 for rotation in place to have its gear teeth 110 contact partial gear teeth 108 to rotate the nozzle selection disc 70 for aligning an individual nozzle 102 as desired. The worm gear nozzle selection shaft 112 has a circular flange 123 adjacent its top to rest on a notched portion 125 in the cylindrical nozzle housing 56. The extension 131 of plate 74 has a portion removed at 135 so that the plate 74 can be lifted off the nozzle housing 56 passing the circular flange 123 to change nozzle selection discs. When the plate 74 and rubber cover 72 are in place for operation, the worm gear nozzle selection shaft 112 is maintained in place for turning the nozzle selection disc 70 with teeth 110 engaging partial gear teeth 108.

The flow chamber 66 has an opening 100 angled upwardly and extending to the outside of nozzle housing 56. This opening 100 is comprised of three sections:

(1) The first section 101 extends from the flow chamber 66 to the inner side 97A of recess 90. First section 101 comprises an opening 104 in the cylindrical nozzle housing 56 and a seal member 106 in said opening for sealing flow through said flow directing passage 100 with the nozzle 70;

(2) The second section comprises a nozzle 102 which is aligned with the seal member 106; and (3) The third section 103 is an exit opening 109 extending from the outer side 97B of recess 90 to the exterior of the cylindrical nozzle housing 56.

A range stream break-up adjustment screw 130 is positioned in the cylindrical nozzle housing 56 to extend downwardly into exit opening 109 in line with the nozzle 102. This adjustment screw 130 can be moved from a position above the flow exiting from a nozzle 102 to various depths extending into the flow. The positioning in the exit flow can alter the exit flow to obtain a desired result.

The support and reenforcing plate 74 and rubber cover 72 have openings where required:

(1) an opening 120 in plate 74 and an opening 122 in rubber cover 72 for the adjustment screw 130;

(2) an opening 124 in plate 74 and an opening 126 in rubber cover 72 for the nozzle adjusting screw 112;

(3) an opening 128 in plate 74 between two extensions 131 and 133 on the plate 74 extending downwardly into open areas of the recess 90 adjacent the upper straight end portions 95 at each end of the nozzle selection disc 70 for the projection of the nozzle selection disc 70 into a groove 134 in the rubber cover 72. The rubber cover 72 has an opening 136 over said recess 90 for viewing the outside rotatable circumference of the nozzle selection disc 70 to indicate the characteristic of the nozzle selected by the markings as viewed through opening 136 on the top of nozzle housing assembly 51.

Figure 6:
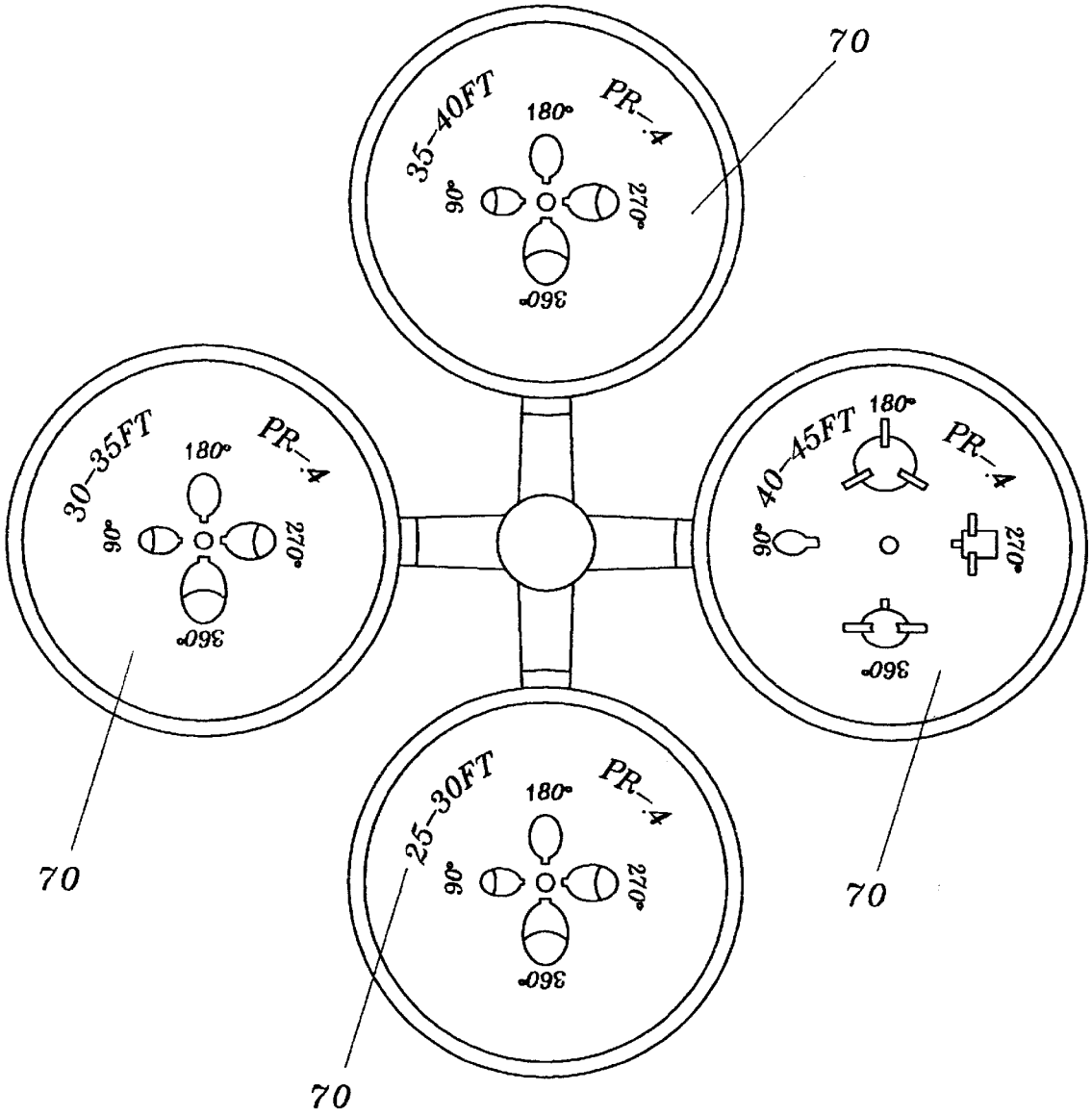
FIG. 6 shows several different nozzle selection discs as might be molded on a runner and sold so that a customer could select the nozzle disc that would provide nozzles with the desired range and precipitation rate for various arc settings. They would be broken off of the runner and installed into the sprinkler nozzle housing.

The nozzle selection discs 70 can be labeled to indicate operating characteristics of the nozzles. In FIG. 6, the discs 70 are labeled to show that at a standard pressure the nozzle disc shown will provide a particular precipitation rate (PR) of 0.4 for the selected range of coverage when used at the indicated arc of coverage. This information can be placed on the face of a nozzle selection disc 70 to aid in selecting a nozzle selection disc 70 to be used. This information can also be placed on the edge of the nozzle selection disc 70 so it can be viewed through opening 136 after the nozzle selection disc 70 has been inserted. Nozzle selection discs of different colors could be provided for different precipitation rates (PR).

While the principles of the invention have now been made clear in illustrative embodiments, it will become obvious to those skilled in the art that many modifications in arrangement are possible without departing from those principles. The appended claims are therefore intended to cover and embrace any such modifications, within the limits of the true spirit and scope of the invention.

We claim:

1. A rotary drive sprinkler comprising a sprinkler housing for receiving a supply of water, a nozzle assembly for directing water therefrom mounted for rotation about an axis x—x, said nozzle assembly having a nozzle housing with a recess for receiving an insertable and removeable cylindrical nozzle selection disc for rotation, said cylindrical nozzle selection disc having a plurality of nozzle openings therearound, said nozzle housing having a flow opening for directing a flow of water to said recess, said cylindrical nozzle selection disc being rotatable in said recess to align one nozzle opening of its plurality of nozzle openings with said flow opening, said aligned nozzle opening directing its flow to the exterior of said nozzle housing.

2. A rotary drive sprinkler comprising a sprinkler housing for receiving a supply of water, a nozzle assembly for directing water therefrom, said nozzle assembly having an outer cylindrical housing with a recess for receiving an insertable cylindrical nozzle selection disc for rotation, said cylindrical nozzle selection disc having a plurality of nozzle openings therearound, said cylindrical housing having a flow opening for directing a flow of water to said recess, said cylindrical nozzle selection disc being rotatable in said recess to align one nozzle opening of its plurality of nozzle openings with said flow opening, said aligned nozzle opening directing its flow to the exterior of said outer cylindrical housing, wherein said recess has a semi-circular shaped bottom to mate with said cylindrical nozzle selection disc.

3. A rotary drive sprinkler as set forth in claim 2 wherein the sides and end surfaces of the recess are straight so that said nozzle selection disc can be inserted to go into said semi-circular shaped bottom of the recess.

4. A rotary drive sprinkler comprising a sprinkler housing for receiving a supply of water, a nozzle assembly for directing water therefrom, said nozzle assembly having an outer cylindrical housing with a recess for receiving an insertable cylindrical nozzle selection disc for rotation, said cylindrical nozzle selection disc having a plurality of nozzle openings therearound, said cylindrical housing having a flow opening for directing a flow of water to said recess, said cylindrical nozzle selection disc being rotatable in said recess to align one nozzle opening of its plurality of nozzle openings with said flow opening, said aligned nozzle opening directing its flow to the exterior of said outer cylindrical housing, wherein the cylindrical housing has a top having a supporting plate and a rubber cover thereon, said rubber cover having an opening over said recess for viewing the end of the nozzle selection disc, said end of the nozzle selection disc having markings indicating information concerning the aligned nozzle opening.

5. A rotary drive sprinkler as set forth in claim 4 wherein said supporting plate has extensions thereon extending down into the top of the recess and each end of the cylindrical nozzle selection disc, said extensions having an arcuate surface facing the cylindrical nozzle selection disc.

6. A rotary drive sprinkler comprising a sprinkler housing for receiving a supply of water, a nozzle assembly for directing water therefrom, said nozzle assembly having an outer cylindrical housing with a recess for receiving an insertable cylindrical nozzle selection disc for rotation, said cylindrical nozzle selection disc having a plurality of nozzle openings therearound, said cylindrical housing having a flow opening for directing a flow of water to said recess, said cylindrical nozzle selection disc being rotatable in said recess to align one nozzle opening of its plurality of nozzle openings with said flow opening, said aligned nozzle opening directing its flow to the exterior of said outer cylindrical housing, wherein said cylindrical housing has a removeable cover, said disc extends into a groove in the bottom of the cover of the cylindrical nozzle housing.

7. A rotary drive sprinkler comprising a sprinkler housing for receiving a supply of water, a nozzle assembly for directing water therefrom, said nozzle assembly having an outer cylindrical housing with a recess for receiving an insertable cylindrical nozzle selection disc for rotation, said cylindrical nozzle selection disc having a plurality of nozzle openings therearound, said cylindrical housing having a flow opening for directing a flow of water to said recess, said cylindrical nozzle selection disc being rotatable in said recess to align one nozzle opening of its plurality of nozzle openings with said flow opening, said aligned nozzle opening directing its flow to the exterior of said outer cylindrical housing, wherein the outer circumference of said cylindrical nozzle selection disc has partial teeth around, a worm gear shaft with teeth is mounted in said cylindrical housing for rotation in place, said shaft teeth meshing with said partial teeth on said cylindrical nozzle selection disc to rotate it and change the position of nozzle openings with respect to said flow opening.

8. A rotary drive sprinkler as set forth in claim 7, wherein said worm gear shaft with teeth can be rotated from the exterior of said nozzle assembly to align a nozzle opening with the flow opening.

9. A rotary drive sprinkler comprising a sprinkler housing for receiving a supply of water, a nozzle assembly for directing water therefrom, said nozzle assembly being mounted for oscillation about a vertical axis, said nozzle assembly having an outer cylindrical housing with a recess extending therefrom from the side of said outer cylindrical housing, a cylindrical nozzle selection disc having a plurality of nozzle openings therearound, said cylindrical nozzle selection disc being insertable and removable directly from said recess at the side of said cylindrical housing, said cylindrical housing having a flow chamber for receiving a flow of water, said flow chamber having a flow opening for directing a flow of water to said recess, said cylindrical nozzle selection disc being rotatable in said recess to align one nozzle opening of its plurality of nozzle openings to cause the selected nozzle opening to direct its flow to the exterior of said outer cylindrical housing through said recess down-stream of said nozzle selection disc.

10. A rotary drive sprinkler comprising a sprinkler housing for receiving a supply of water, a nozzle assembly for directing water therefrom, said nozzle assembly being mounted for rotation to direct water for ground cover, said nozzle assembly having an outer cylindrical housing having a top containing a recess, said recess extending downwardly from said top of said cylindrical housing, a nozzle selection member for movement therein, said nozzle selection member having a plurality of nozzle openings therein, said recess being sized to allow said nozzle selection member to be inserted and removed from said recess, said cylindrical housing having a flow passage for receiving a flow of water, said flow passage having a flow opening for directing a flow of water to a certain area of said recess, said nozzle selection member being movable to bring one nozzle opening into the certain area of said recess to align the one nozzle opening of its plurality of nozzle openings with said flow opening, said aligned nozzle opening directing its flow to the exterior of said outer cylindrical housing.

11. A rotary drive sprinkler comprising a sprinkler housing for receiving a supply of water, a nozzle assembly for directing water therefrom, said nozzle assembly having an outer cylindrical housing with a recess extending from the top thereof, a cylindrical nozzle selection disc, said cylindrical nozzle selection disc being inserted in said recess, said cylindrical nozzle selection disc having a plurality of nozzle openings therearound, said cylindrical housing having a flow opening for directing a flow of water to said recess, said recess having straight sides and end surfaces extending into said cylindrical housing, said cylindrical nozzle selection disc being rotatable in said recess to align one nozzle opening of its plurality of nozzle openings with said flow opening, said aligned nozzle opening directing its flow to the exterior of said outer cylindrical housing.

12. A rotary drive sprinkler comprising a sprinkler housing for receiving a supply of water, a nozzle assembly for directing water therefrom, said nozzle assembly being mounted for oscillation about a vertical axis, said nozzle assembly having an outer cylindrical housing having a top, said nozzle assembly having a recess extending thereinto from the top of said outer cylindrical housing, a nozzle selection disc having a plurality of nozzle openings therearound, said nozzle selection disc being directly inserted in said recess from the top of said cylindrical housing, said nozzle selection disc also being directly removed from said recess at the top of said cylindrical housing, said cylindrical housing having a flow chamber for receiving a flow of water, said flow chamber having a flow opening for directing a flow of water to said recess, said cylindrical nozzle selection disc being rotatable in said recess to align one nozzle opening of its plurality of nozzle openings to cause the selected nozzle opening to direct its flow to the exterior of said outer cylindrical housing.

13. A rotary drive sprinkler as set forth in claim 12 wherein said recess has straight sides and end surfaces extending to a semi-circular shaped bottom.

14. A rotary drive sprinkler as set forth in claim 12 wherein said recess has straight sides and end surfaces extending from the top of said outer cylindrical housing.

15. A rotary drive sprinkler as set forth in claim 12 having a removable cover on said outer cylindrical housing top, said cover having an opening over said recess for viewing the end of the nozzle selection disc having markings indicating information concerning the aligned nozzle opening.

16. A rotary drive sprinkler as set forth in claim 15 wherein said nozzle selection disc extends out of said recess, a groove in the bottom of said cover receiving the extension of said nozzle selection disc.

17. A rotary drive sprinkler comprising a sprinkler housing for receiving a supply of water, a nozzle assembly for directing water therefrom, said nozzle assembly having a cylindrical housing, said cylindrical housing having a flow chamber receiving a flow of water from said sprinkler housing, a position shaft for setting an arc of rotation of said nozzle assembly, said cylindrical housing having a cover, an indicating member for arc set being mounted for rotation in said cylindrical housing above said flow chamber, said position shaft extending from said indicating member to said sprinkler housing through said flow chamber.

18. A rotary drive sprinkler as set forth in claim 9 having an actuator shaft for setting an arc of rotation of said nozzle assembly, said cylindrical housing having a cover, an indicating member for arc set being mounted in said cylindrical housing above said flow chamber, said actuator shaft extending from said indicating member through said flow chamber to said sprinkler housing, said indicating member extending through said cover permitting said arc of rotation to be viewed.

19. A rotary drive sprinkler as set forth in claim 1 wherein said recess is located in the side of the nozzle housing.

20. A rotary drive sprinkler as set forth in claim 19 wherein a stream break-up screw is positioned in the nozzle housing to extend downwardly into said recess.

21. A rotary drive sprinkler as set forth in claim 19 wherein said recess is angled upwardly to receive the cylindrical nozzle selection disc at the bottom of said recess, a flow passage enters the bottom of said recess to direct flow to the nozzle openings of said cylindrical nozzle selection disc, the cylindrical nozzle selection disc is positioned for rotation about its center at the bottom of the recess.

22. A rotary drive sprinkler as set forth in claim 21 wherein said recess is circular.

23. A rotary drive sprinkler as set forth in claim 19 wherein said flow of water being directed to the exterior of said nozzle housing is directed through said recess downstream of said nozzle selection disc.

24. A rotary drive sprinkler comprising a sprinkler housing for receiving a supply of water, a nozzle assembly for directing water therefrom, said nozzle assembly being mounted for oscillation about a vertical axis, said nozzle assembly having an outer cylindrical housing having a top, a recess in said cylindrical housing top to allow a nozzle selection disc to be inserted to place it in line with a flow passage to supply water to a nozzle opening, said nozzle selection disc having a plurality of nozzle openings therearound, said nozzle selection disc can be inserted in and removed from said recess from the top of said cylindrical housing, said cylindrical housing having a flow chamber for receiving a flow of water, said flow chamber having a flow passage for directing a flow of water to said recess, said nozzle selection disc being rotatable in said recess to align one nozzle opening of its plurality of nozzle openings to cause the selected nozzle opening to direct its flow to the exterior of said outer cylindrical housing.

25. A rotary drive sprinkler as set forth in claim 9 wherein a stream break-up screw is positioned in the outer cylindrical housing to extend downwardly into said recess.

26. A rotary drive sprinkler as set forth in claim 10 wherein a stream break-up screw is positioned in the outer cylindrical housing to extend downwardly into the flow directed from said aligned nozzle opening.

* * * * *